US006762717B2

(12) United States Patent
Hirabe

(10) Patent No.: US 6,762,717 B2
(45) Date of Patent: Jul. 13, 2004

(54) APPARATUS AND METHOD FOR CALIBRATING ARRAY ANTENNA

(75) Inventor: Masashi Hirabe, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/241,557

(22) Filed: Sep. 12, 2002

(65) Prior Publication Data

US 2003/0058166 A1 Mar. 27, 2003

(30) Foreign Application Priority Data

Sep. 17, 2001 (JP) ..... 281662/2001

(51) Int. Cl.[7] ..... H01Q 3/22
(52) U.S. Cl. ..... 342/368; 342/174
(58) Field of Search ..... 342/165, 174, 342/372, 373, 368

(56) References Cited

FOREIGN PATENT DOCUMENTS

| | | | |
|---|---|---|---|
| EP | 1104122 | * | 5/2001 |
| EP | 1235361 | * | 8/2002 |
| JP | 10-336149 A | | 12/1998 |
| JP | 2000-151255 A | | 5/2000 |
| JP | 2000-295152 A | | 10/2000 |

* cited by examiner

*Primary Examiner*—Dao Phan
(74) *Attorney, Agent, or Firm*—Sughrue Mion, PLLC

(57) ABSTRACT

A calibration apparatus for an array of antenna elements. The apparatus includes a plurality of first antenna elements in the array of antenna elements, and a calibration signal supplier for supplying a calibration signal to a second antenna element near at least two first antenna elements, or a coupler connected to the first antenna element. The calibration apparatus further includes a section which obtains a relative phase fluctuation between the antenna elements based on the calibration signal received by the plurality of antenna elements and user signals received respectively by the antenna elements. The calibration apparatus further includes a calibration factor supplier which obtains a relative amplitude fluctuation between the antenna elements of the array antenna based on the calibration signals received by at least first antenna elements and the user signals received respectively by the antenna elements, and a beam former which calibrates the user signals received respectively by the antenna elements using the relative phase fluctuation and the relative amplitude fluctuation.

6 Claims, 6 Drawing Sheets

APPARATUS AND METHOD FOR CALIBRATING ARRAY ANTENNA

BACKGROUND OF THE INVENTION

1. Field of the Invention

The present invention relates to an apparatus and method for calibrating an array antenna.

2. Description of the Related Art

To form an accurate receiver beam in a digital beam forming device, it is necessary in beam forming to make uniform the amplitude characteristics and the phase characteristics of the outputs of receivers provided to antenna elements respectively.

An array antenna calibration apparatus is disclosed in Jpn. Pat. Appln. KOKAI Publication No. 2000-151255 (Method and Apparatus for Calibrating Array Antenna) and Jpn. Pat. Appln. KOKAI Publication No. Hei 10-336149 (Array Antenna radio CDMA Communication Apparatus). The configuration of one example of conventional array antenna calibration apparatuses is shown in FIG. 5.

In this array antenna calibration apparatus, between antenna elements 801-2 through 801-5 and receivers 802-1 through 802-4 are provided couplers 821-1 through 821-4 respectively, so that a calibration signal generated by a calibration signal generator 810 is divided by a divider 809. Thus divided calibration signals are input from the couplers 821-1 through 821-4 to the receivers 802-1 through 802-4 respectively. The calibration signals thus received by the receivers 802-1 through 802-4 undergo propagation factor estimation at propagation factor estimators 808-1 through 808-4 of a calibration signal processor 806 respectively, which output propagation factors to a calibration factor calculator 805. The calibration factor calculator 805 then calculates a calibration factor based on the propagation factors so that the amplitudes and phases of the signals from the receivers 802-1 through 802-4 may be equal respectively. Thus obtained calibration factor is input to beam former 803 of each user, and the beamformer 803 correct their respective output signals from the receivers 802-1 through 802-4 according to the calibration factor.

In such a conventional calibration apparatus, the calibration signals do not pass through the antenna elements 801-2 through 801-5 nor interconnections between them and the couplers 821-1 through 821-4, so that it cannot correct fluctuations in characteristics caused by these components, which is a problem. Furthermore, in the conventional calibration apparatus, when the calibration signals are input to the receivers 802-1 through 802-4, they must be equal in both amplitude and phase. This necessity gives rise to a problem that the divider 809 and the couplers 821-1 through 821-4 must have performance of high accuracy and high stability.

To solve these problems, there has been disclosed such a conventional method as shown in FIG. 6. This conventional method is disclosed in Jpn. Pat. Appln. KOKAI Publication No. 2000-295152 (Array Antenna Radio Communication Apparatus). By this calibration method, a calibration signal generator 810 is installed at a position where there is no obstacle to an array antenna at a base station, in order to transmit a calibration signal therefrom to the base station array antenna. By this calibration method, the calibration signal is received by the antenna elements 801-2 through 802-5 and the receivers 802-1 through 802-4 for calibration. The calibration signal can pass through from the antenna elements 801-1 through 801-5 to the receivers 802-1 through 802-4 all the way for calibration. The method, however, has a problem that the calibration signal generator must be installed within an unobstructed range of the base station. Furthermore, it has another problem that it is necessary to know an accurate positional relationship between the base station and the signal generator.

SUMMARY OF THE INVENTION

In view of the above, it is an object of the present invention to provide an array antenna calibration apparatus and method which can take into account the characteristics of a propagation factor ranging from an antenna element to a receiver and also which eliminates the necessity of knowing a positional relationship between a base station and a signal generator.

The present invention provides a novel calibration apparatus and method which calibrates the reception characteristics of a linear array antenna used at the base station. A configuration of the apparatus of the present invention is described with reference to FIG. 1.

The array antenna calibration apparatus of the present invention comprises a plurality of antenna elements 1-2 through 1-5 which makes up an array antenna, receivers 2-1 through 2-4 connected to said antenna elements respectively, propagation factor estimators 4-1 through 4-4 which estimate propagation factors of user signals output from said receivers 2-1 through 2-4 respectively, antenna elements 1-1 and 1-6 which send a calibration signal to said array antenna, a calibration signal supplier 30-1 which transmits an equi-amplitude/equi-phase calibration signal from said antenna elements 1-1 and 1-6, a calibration factor supplier 40 which has means for obtaining a relative phase fluctuation and a relative amplitude fluctuation between said array antenna and said antenna elements, and a beam former 3 which calibrates said user signal received by each of said antenna elements of said array antenna based on said relative phase fluctuation and said relative amplitude fluctuation.

Furthermore, the calibration signal supplier 30-1 has a calibration signal generator 10 and a divider 9 for transmitting an equi-amplitude/equi-phase calibration signal, for supplying the calibration signal to the antennas 1-1 and 1-6 added to the two ends of the array antenna respectively so that the phase characteristics and the amplitude characteristics of outputs of the receivers 2-1 through 2-4 connected to the antenna elements 1-2 through 1-5 respectively may be made uniform.

Furthermore, a calibration factor supplier 40-1 is comprised of a calibration signal processor 6 which processes the calibration signal received by the antenna elements 1-2 and 1-5 at the two ends of the array antenna to which the receivers 2-1 and 2-4 are connected respectively and a calibration factor calculator 5 which calculates a calibration factor using the information of a phase difference of the calibration signal sent from the calibration signal processor 6 and a transmission path estimate value sent from each of the transmission path estimators 4-1 through 4-4 of each user. In this configuration, the calibration factor supplier 40-1 obtains a relative phase fluctuation and a relative amplitude fluctuation between the antenna elements of the array antenna based on the calibration signal received by the antenna element and the user signal received by each of the antenna elements of the array antenna, thus sending the calibration factor to the beam former 3.

The following will describe a calibration method of the present invention. The calibration signals transmitted from the antenna elements 1-1 and 1-6 are received by the receivers 2-1 and 2-4 through the antenna elements 1-2 and 1-5, respectively, owing to electromagnetic coupling between the antenna elements. The calibration signals received by the receivers 2-1 and 2-4 are sent to propagation factor estimators 8-1 and 8-2 of the calibration signal processor 6 respectively for estimation of their respective propagation factors.

The resulting propagation factors are used by a phase difference calculator 7 of the calibration signal processor 6 to calculate a phase difference between the outputs of the receivers 2-1 and 2-4 and then send it to the calibration factor calculator 5.

Furthermore, the user signals are received through the antenna elements 1-2 through 1-5 and the receivers 2-1 through 2-4 in this order and sent to the propagation factor estimators 4-1 through 4-4, where propagation factors of these user signals received at the antenna elements are estimated and output as a propagation factor. Thus given propagation estimate value is sent to the beam former 3 to be used to form a user-specific beam and also sent to the calibration factor calculator 5.

The calibration factor calculator 5 then uses the phase difference between the calibration signals and the user-specific propagation factor at each of the antenna elements, thus calculating a calibration factor for the output of each of the receivers 2-1 through 2-4. In calculation of the calibration factor, it is not necessary to use the propagation factors of all the users but they may be selected as many as an arbitrary number. Furthermore, the calibration factor obtained by the calibration factor calculator 5 is posted sent to the beam former 3 of each of the users, to be used there in order to correct the reception signal output from each of the receivers 2-1 through 2-4 for beam formation.

As described above, the present invention features that a user signal received and a calibration signal supplied through inter-antenna element coupling are used to make uniform the amplitude and phase characteristics of the receivers for calibration of the antenna.

The present invention provides an array antenna calibration apparatus comprising:

- a plurality of first antenna elements in said antenna elements for calibration;
- a calibration signal supplier for supplying a calibration signal to a second antenna element near at least two said first antenna elements of said array antenna, or a coupler connected to said first antenna element;
- a calibration factor supplier for obtaining a relative phase fluctuation and a relative amplitude fluctuation between said antenna elements of said array antenna based on the calibration signal received by said at least two first antenna elements and user signals received respectively by said antenna elements of said array antenna; and
- a beam former for calibrating said user signals received respectively by said antenna elements of said array antenna using said relative phase fluctuation and said relative amplitude fluctuation.

The calibration factor supplier may, but not necessarily, include:

- apparatus for obtaining a propagation factor relating to said calibration signal for each of said first antenna elements based on said calibration signal received by each of said first antenna elements;
- apparatus for obtaining a first phase difference of said propagation factor relating to said calibration signal between said first antenna elements based on said propagation factor;
- apparatus for obtaining an average of said phase differences of said propagation factors relating to said calibration signals between said first antenna elements based on said phase differences of said propagation factors;
- apparatus for obtaining an average of the propagation factors relating to said user signals for each of said antenna elements of said array antenna based on said user signals;
- apparatus for obtaining a phase difference between said antenna elements caused by a difference in length of arrival paths based on said average of said phase differences and said average of said propagation factors;
- apparatus for obtaining a first time-average of the relative phase fluctuations of each of said antenna elements with respect to the one of said first antenna elements as a reference, based on said average of said propagation factors relating to said user signals for each of said antenna elements of said array antenna, said average of said propagation factors relating to said user signals for each of said first antenna elements, and said phase difference between said antenna elements caused by the difference in length of said arrival paths; and
- apparatus for obtaining a second time-average of the relative phase fluctuations of said first antenna which are not used as a reference, based on the phase difference of said propagation factors relating to said calibration signal between said first antenna elements.

The calibration factor supplier may, but not necessarily, include:

- apparatus for obtaining the propagation factor relating to said calibration signal for each of said first antenna elements based on said calibration signal received by each of said first antenna elements;
- apparatus for obtaining the phase difference of said propagation factor relating to said calibration signal between said first antenna elements based on said propagation factor relating to said calibration signal;
- apparatus for obtaining the average of said phase differences of said propagation factors relating to said calibration signals between said first antenna elements based on said phase differences of said propagation factors;
- apparatus for obtaining the average of said propagation factors relating to said user signals for each of said antenna elements of said array antenna;
- apparatus for obtaining the phase difference between said antenna elements caused by the difference in length of the arrival paths based on said average of said phase differences of said propagation factors and said average of said propagation factors; and
- apparatus for obtaining a time-average of the relative amplitude fluctuations for each of said antenna elements of said array antenna with respect to one of said antenna elements of said array antenna based on said average of the propagation factors.

DESCRIPTION OF THE PREFERRED EMBODIMENTS

The following will describe embodiments of the present invention with reference to drawings.

First Embodiment

Figure 1:
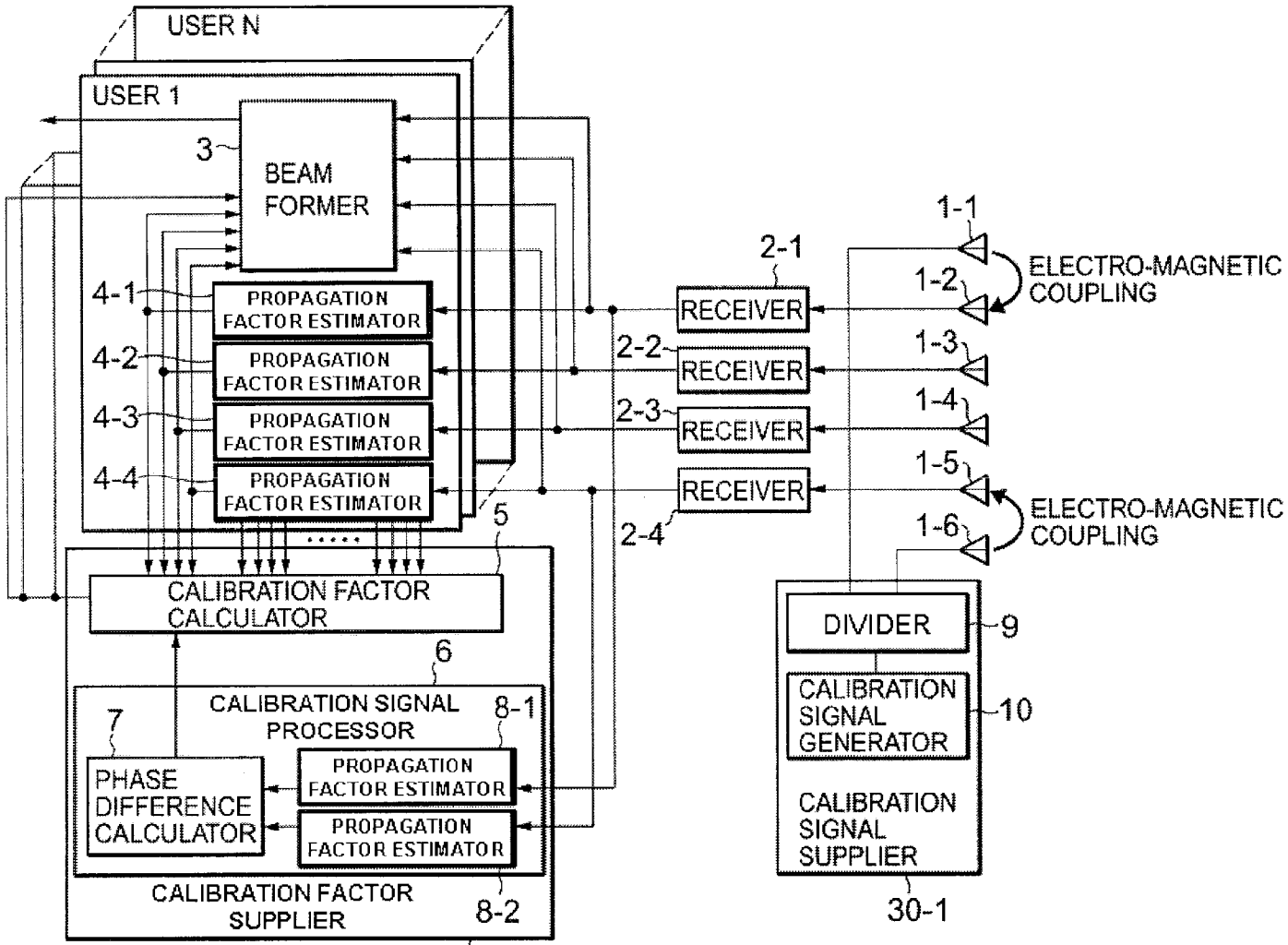
FIG. 1 is a block diagram for showing a configuration of an array antenna calibration apparatus according to the present invention.
Figure 2:
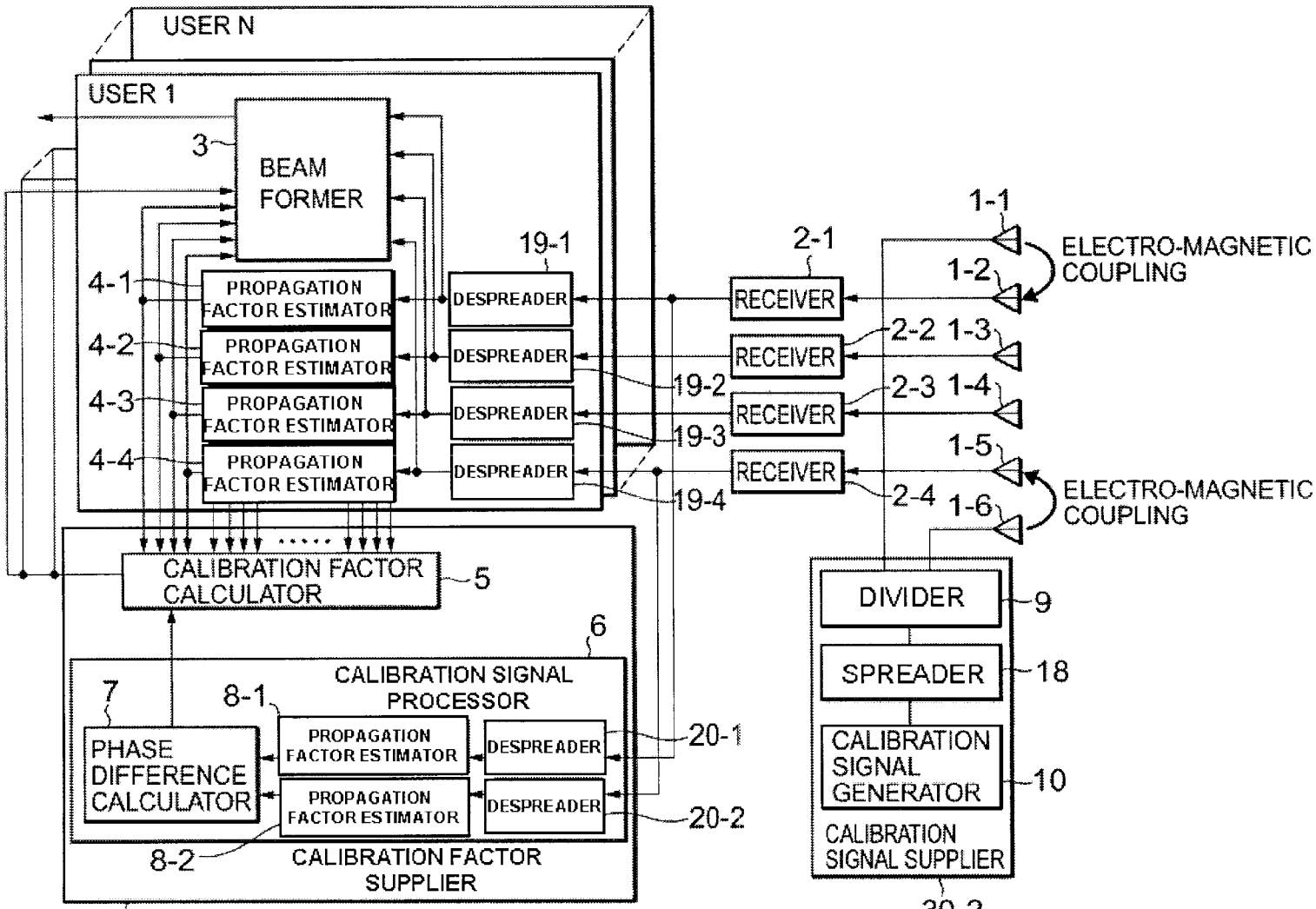
FIG. 2 is a block diagram for showing a configuration of an array antenna calibration apparatus according to a first embodiment of the present invention.

The first embodiment of the present invention is described with reference to FIG. 2 as follows. FIG. 2 shows a configuration of a base station using a linear array antenna of a CDMA communication system. In the present embodiment, a basic array antenna calibration apparatus of the present invention shown in FIG. 1 is applied to the CDMA communication-system base station.

The array antenna calibration apparatus of the present embodiment mainly comprises:

- a plurality of antenna elements 1-2 through 1-5 which makes up an array antenna;
- receivers 2-1 through 2-4 connected to said antenna elements respectively;
- despreader 19-1 through 19-4 which extract a signal arriving through one user path from a signal output from said receivers 2-1 through 2-4;
- propagation factor estimators 4-1 through 4-4 which estimate a propagation factor of thus despread signal;
- antenna elements 1-1 and 1-6 which send a calibration signal to said array antenna;
- calibration signal supplier 30-2 which transmits the equi-amplitude/equi-phase spread calibration signal from said antenna elements 1-1 and 1-6;
- a calibration factor supplier 40-2 having means which obtains a relative phase fluctuation and a relative amplitude fluctuation between said antenna elements of said array antenna; and
- a beam former 3 which calibrates a user signal received by each of said antenna elements of said array antenna using the relative phase fluctuation and the relative amplitude fluctuation.

Furthermore, said calibration signal supplier 30-2 in the present embodiment has a calibration signal generator 10, a spreader 18, and a divider 9 for transmitting the equi-amplitude/equi-phase spread calibration signal, to supply the spread calibration signal to the antenna elements 1-1 and 1-6 added respectively to the two ends of the array antenna in order to make uniform the phase characteristics and the amplitude characteristics of outputs of said receivers 2-1 through 2-4 connected to said antenna elements 1-2 through 1-5 respectively.

Furthermore, said calibration factor supplier 40-2 in the present embodiment is comprised of a calibration signal processor 6 which processes the spread calibration signal received by the antenna elements 1-2 and 1-5 disposed respectively at the two ends of the array antenna to which the receivers 2-1 and 2-4 are connected and a calibration factor calculator 5 which calculates a calibration factor using information of the phase difference of the calibration signal sent from said calibration signal processor 6 and the propagation factor sent from said propagation factor estimators 4-1 through 4-4 of each of the users. The calibration signal processor 6 has despreaders 20-1 and 20-2, propagation factor estimators 8-1 and 8-2, and a phase difference calculator 7, to calculate a phase difference based on the two spread calibration signals sent respectively from the receivers 2-1 and 2-2.

In a configuration of the present embodiment, the calibration factor supplier 40-2 can obtain a relative phase fluctuation and a relative amplitude fluctuation between the antenna elements of the array antenna based on the spread calibration signals received by the antenna elements and the user signal received by each of the antenna elements. As a result, the calibration factor supplier 40-2 can sent an appropriate calibration factor to the beam former 3.

The following will sequentially describe the operations of the array antenna calibration apparatus according to the first embodiment of the present invention.

The calibration signals transmitted in an equi-amplitude/equi-phase manner from the antenna elements 1-1 and 1-6 are received by the receivers 2-1 and 2-4 as coupled respectively with the antenna elements 1-2 and 1-5 electromagnetically. The outputs of the receivers 2-1 and 2-4 fluctuate in amplitude and phase and also time-wise due to fluctuations in characteristics of the antenna elements 1-2 and 1-5, those in characteristics of receivers 2-1 and 2-4, and those of characteristics of cables interconnecting the antenna elements 1-2 and 1-5 and the receivers 2-1 and 2-4 respectively. Assuming the number of the calibration signals to be one, the output signals $x_{cal1}$ (t) and $x_{cal4}$ (t) of the respective receivers 2-1 and 2-4 are as given follows:

$$x_{cal1}(t) = A_1(t)\exp(j\cdot\omega\cdot t + j\cdot\varphi_1(t)) \quad (1)$$

$$x_{cal4}(t) = A_4(t)\exp(j\cdot\omega\cdot t + j\cdot\varphi_4(t)) \quad (2)$$

where $A_1(t)$ and $A_4(t)$ indicate amplitude fluctuations of the receivers 2-1 and 2-4 respectively and $\phi_1(t)$ and $\phi_4(t)$ indicate phase fluctuations.

The calibration signals output respectively from the receivers 2-1 and 2-4 are despread by despreaders 20-1 and 20-2 of the calibration signal processor 6 and then sent to propagation factor estimators 8-1 and 8-2 to estimate propagation factors based thereon, thus calculating propagation factors (calibration signal propagation factor estimation step). The propagation factors $h_{cal1}(t)$ and $h_{cal4}(t)$ are given as follows:

$$h_{cal1}(t) = A_1(t)\exp(j\cdot\varphi_1(t)) \quad (3)$$

$$h_{cal4}(t) = A_4(t)\exp(j\cdot\varphi_4(t)) \quad (4)$$

A phase difference calculator 7 of the calibration signal processor 6 uses these propagation factors $h_{cal1}(t)$ and $h_{cal4}(t)$ to calculate a phase difference $\delta h_{cal}(t)$ between the outputs of the receivers 2-1 and 2-4 and then send it to the calibration factor calculator 5 (calibration signal phase difference calculation step). The phase difference $\delta h_{cal}(t)$ of the propagation factors is obtained as follows:

$$\delta h_{cal}(t) = \frac{h_{cal1}(t)\cdot h_{cal4}^{*}(t)}{|h_{cal1}(t)\cdot h_{cal4}^{*}(t)|} = \frac{A_1(t)\exp(j\cdot\varphi_1(t))\cdot A_4(t)\exp(-j\cdot\varphi_4(t))}{|A_1(t)\exp(j\cdot\varphi_1(t))\cdot A_4(t)\exp(-j\cdot\varphi_4(t))|} = \exp\{j\cdot(\varphi_1(t)-\varphi_4(t))\} \tag{5}$$

where * indicates a conjugate complex number.

Each of the output signals from the receivers 2-1 through 2-4 is divided by the despreaders 19-1 through 19-4 into a plurality of separate components for each of the users and paths, so that for each of the users and paths the propagation factor estimators 4-1 through 4-4 estimate propagation factors, thus calculating propagation factors (user signal propagation factor estimation step). In this case, propagation factors $h_1(k, l, t)$, $h_2(k, l, t)$, $h_3(k, l, t)$, and $h_4(k, l, t)$ of a signal sent through path l from user k at a moment t are given as follows:

$$h_1(k, l, t) = A(k, l, t)\cdot A_1(t)\cdot\exp(j\cdot\varphi_1(t)) \tag{6}$$

$$h_2(k, l, t) = A(k, l, t)\cdot\exp\{j\cdot\beta\cdot d\cdot\sin(\theta(k, l, t))\}\cdot A_2(t)\cdot\exp(j\cdot\varphi_2(t)) \tag{7}$$

$$h_3(k, l, t) = A(k, l, t)\cdot\exp\{j\cdot 2\cdot\beta\cdot d\cdot\sin(\theta(k, l, t))\}\cdot A_3(t)\cdot\exp(j\cdot\varphi_3(t)) \tag{8}$$

$$h_4(k, l, t) = A(k, l, t)\cdot\exp\{j\cdot 3\cdot\beta\cdot d\cdot\sin(\theta(k, l, t))\}\cdot A_4(t)\cdot\exp(j\cdot\varphi_4(t)) \tag{9}$$

where $A_1(t)$, $A_2(t)$, $A_3(t)$, and $A_4(t)$ indicate amplitude fluctuations of the receivers 2-1 through 2-4 respectively, and $\phi_1(t)$, $\phi_2(t)$, $\phi_3(t)$, and $\phi_4(t)$ indicate phase fluctuations of the receivers 2-1 through 2-4. Furthermore, A(k, l, t) indicates an amplitude of user k through path 1 at a sampling moment t, θ (k, l, t) indicates an arrival direction, β indicates a free space propagation constant (2π/wavelength), and d indicates an inter-antenna element spacing.

Next, the estimated propagation factors $h_1(k, l, t)$, $h_2(k, l, t)$, $h_3(k, l, t)$, and $h_4(k, l, t)$ are sent to the calibration factor calculator 5.

The calibration factor calculator 5 has a function to perform the following step to obtain a relative phase fluctuation and a relative amplitude fluctuation between the antenna elements of the array antenna in order to calculate a calibration factor for forming the beam of each of the user signals. This function is explained below along equations.

The calibration factor calculator 5 calculates a calibration factor for each of the outputs of the receivers 2-1 through 2-4 using a phase difference $\delta h_{cal}(t)$ of the calibration signal and propagation factors $h_1(k, l, t)$, $h_2(k, l, t)$, $h_3(k, l, t)$, and $h_4(k, l, t)$ of the respective antenna elements for each user through each path. Although an arbitrary number of the propagation factors can be selected and used in calculation, in this example a T number of samples of propagation factors for a K number of users through L number of paths for each of the users are selected and used.

First, the calibration factor calculator 5 calculates geometric average values $H_1$, $H_2$, $H_3$, and $H_4$ of the propagation factors of the samples of the users through the paths for the respective antenna elements.

$$H_1 = \sqrt[K\cdot L\cdot T]{\prod_{k=1}^{K}\prod_{l=1}^{L}\prod_{t=1}^{T} h_1(k, l, t)} = \sqrt[K\cdot L\cdot T]{\prod_{k=1}^{K}\prod_{l=1}^{L}\prod_{t=1}^{T} A(k, l, t)\cdot A_1(t)}\cdot\exp\left\{j\cdot\frac{1}{T}\sum_{t=1}^{T}\varphi_1(t)\right\} \tag{10}$$

-continued $$H_2 = \sqrt[K\cdot L\cdot T]{\prod_{k=1}^{K}\prod_{l=1}^{L}\prod_{t=1}^{T} h_2(k, l, t)} = \sqrt[K\cdot L\cdot T]{\prod_{k=1}^{K}\prod_{l=1}^{L}\prod_{t=1}^{T} A(k, l, t)\cdot A_2(t)}\cdot\exp\left\{j\cdot\frac{\beta\cdot d}{K\cdot L\cdot T}\sum_{k=1}^{K}\sum_{l=1}^{L}\sum_{t=1}^{T}\sin(\theta(k, l, t)) + j\cdot\frac{1}{T}\sum_{t=1}^{T}\varphi_2(t)\right\} \tag{11}$$

$$H_3 = \sqrt[K\cdot L\cdot T]{\prod_{k=1}^{K}\prod_{l=1}^{L}\prod_{t=1}^{T} h_3(k, l, t)} = \sqrt[K\cdot L\cdot T]{\prod_{k=1}^{K}\prod_{l=1}^{L}\prod_{t=1}^{T} A(k, l, t)\cdot A_3(t)}\cdot\exp\left\{j\cdot\frac{2\cdot\beta\cdot d}{K\cdot L\cdot T}\sum_{k=1}^{K}\sum_{l=1}^{L}\sum_{t=1}^{T}\sin(\theta(k, l, t)) + j\cdot\frac{1}{T}\sum_{t=1}^{T}\varphi_3(t)\right\} \tag{12}$$

$$H_4 = \sqrt[K\cdot L\cdot T]{\prod_{k=1}^{K}\prod_{l=1}^{L}\prod_{t=1}^{T} h_4(k, l, t)} = \sqrt[K\cdot L\cdot T]{\prod_{k=1}^{K}\prod_{l=1}^{L}\prod_{t=1}^{T} A(k, l, t)\cdot A_4(t)}\exp\left\{j\cdot\frac{3\cdot\beta\cdot d}{K\cdot L\cdot T}\sum_{k=1}^{K}\sum_{l=1}^{L}\sum_{t=1}^{T}\sin(\theta(k, l, t)) + j\cdot\frac{1}{T}\sum_{t=1}^{T}\varphi_4(t)\right\} \tag{13}$$

Next, the calibration factor calculator 5 calculates a geometric average value $\Delta H_{cal}$ of phase differences between the calibration signals (phase difference geometric average value calculation step)as follows:

$$\Delta H_{cal} = \sqrt[T]{\prod_{t=1}^{T}\delta h_{cal}(t)} = \exp\left\{j\cdot\sum_{t=1}^{T}(\varphi_1(t)-\varphi_4(t))\right\} \tag{14}$$

Next, the calibration factor calculator 5 uses values of Equations (10), (13), and (14) to obtain a phase difference ΔW between the antenna elements caused by a difference in length of the arrival paths as follows (arrival path phase difference calculation step):

$$\Delta W = \sqrt[3]{\frac{H_1\cdot H_4^{*}}{|H_1\cdot H_4^{*}|}\cdot\Delta H_{cal}} = \exp\left\{j\cdot\frac{\beta\cdot d}{K\cdot L\cdot T}\sum_{k=1}^{K}\sum_{l=1}^{L}\sum_{t=1}^{T}\sin(\theta(k, l, t))\right\} \tag{15}$$

Next, the calibration factor calculator 5 uses a value of Equation (15) to thereby obtain time-averages $\Delta W_{\phi 2}$ and $\Delta W_{\phi 3}$ of the relative phase fluctuations (with respect to the antenna element 1-2) in receiver output of the antenna elements 1-3 and 1-4 as follows (first relative phase fluctuation calculation step):

$$\Delta W_{\varphi 2} = \frac{H_1\cdot H_2^{*}}{|H_1\cdot H_2^{*}|}\cdot\Delta W = \exp\left\{j\cdot\frac{1}{T}\sum_{t=1}^{T}(\varphi_1(t)-\varphi_2(t))\right\} \tag{16}$$

$$\Delta W_{\varphi 3} = \frac{H_1\cdot H_3^{*}}{|H_1\cdot H_3^{*}|}\cdot\Delta W = \exp\left\{j\cdot\frac{1}{T}\sum_{t=1}^{T}(\varphi_1(t)-\varphi_3(t))\right\} \tag{17}$$

Furthermore, the calibration factor calculator 5 uses the calibration signal to thereby obtain a time-average $\Delta W_{100\ 4}$ of the relative phase fluctuations in receiver output of the antenna element 1-5 as follows (second relative phase fluctuation calculation step):

$$\Delta W_{\varphi 4} = \Delta H_{cal} = \exp\left\{ j \cdot \sum_{t=1}^{T} (\varphi_1(t) - \varphi_4(t)) \right\} \tag{18}$$

Next, the calibration factor calculator 5 uses geometric averages H1 through H4 to thereby obtain time-averages $\Delta A_2$, $\Delta A_3$, and $\Delta A_4$ of the relative amplitude fluctuations in receiver output (with respect to the antenna element 1-2) as follows (relative amplitude fluctuation calculation step):

$$\Delta A_2 = \left|\frac{H_1}{H_2}\right| = \sqrt[T]{\prod_{t=1}^{T} \frac{A_1(t)}{A_2(t)}} \tag{19}$$

$$\Delta A_3 = \left|\frac{H_1}{H_3}\right| = \sqrt[T]{\prod_{t=1}^{T} \frac{A_1(t)}{A_3(t)}} \tag{20}$$

$$\Delta A_4 = \left|\frac{H_1}{H_4}\right| = \sqrt[T]{\prod_{t=1}^{T} \frac{A_1(t)}{A_4(t)}} \tag{21}$$

The calibration factor calculator 5, therefore, obtains calibration factors $\Delta W_1$, $\Delta W_2$, $\Delta W_3$, and $\Delta W_4$ of the outputs of the respective receivers 2-1 through 2-4 as follows (calibration factor calculation step):

$$\Delta W_1 = 1 \tag{22}$$

$$\Delta W_2 = \Delta A_2 \cdot \Delta W_{\varphi 2} \tag{23}$$

$$\Delta W_3 = \Delta A_3 \cdot \Delta W_{\varphi 3} \tag{24}$$

$$\Delta W_4 = \Delta A_4 \cdot \Delta W_{\varphi 4} \tag{25}$$

Furthermore, by selecting an averaging time T sufficiently shorter than the characteristics fluctuating time of the receivers 2-1 through 2-4, Equations (16)–(18) and (19)–(21) are transformed into the following equations (26)–(28) and (29)–(31) respectively:

$$\Delta W_{\varphi 2} \approx \exp(\varphi_1(t) - \varphi_2(t)) \tag{26}$$

$$\Delta W_{\varphi 3} \approx \exp(\varphi_1(t) - \varphi_3(t)) \tag{27}$$

$$\Delta W_{\varphi 4} \approx \exp(\varphi_1(t) - \varphi_4(t)) \tag{28}$$

$$\Delta A_2 \approx \frac{A_1(t)}{A_2(t)} \tag{29}$$

$$\Delta A_3 \approx \frac{A_1(t)}{A_3(t)} \tag{30}$$

$$\Delta A_4 \approx \frac{A_1(t)}{A_4(t)} \tag{31}$$

Thus obtained Equations (26)–(28) and (29)–(31) indicate the relative phase characteristics and the relative amplitude characteristics of the respective receivers 2-1 through 2-4 with respect to an output of the receiver 2-1, showing that the characteristics fluctuations in output of the receivers can be made uniform by using Equations (22)–(25) as a calibration factor.

Therefore, a calibration factor obtained by the calibration factor calculator 5 can be sent to the beam former 3 of each of the users through each of the paths, so that the calibration factor calibration factor can be applied to an output signal of each of the receivers 2-1 through 2-5 at the beam former through each of the paths for each of the users, thus removing the fluctuations in amplitude and phase of each of the receivers 2-1 through 2-4. As a result, accurate beam forming is possible.

Although the functions of the present invention have been described sequentially along the equations, of course some of these equations can be unified and so their values need not appear during the course of calculations in the actual operations.

Second Embodiment

Figure 3:
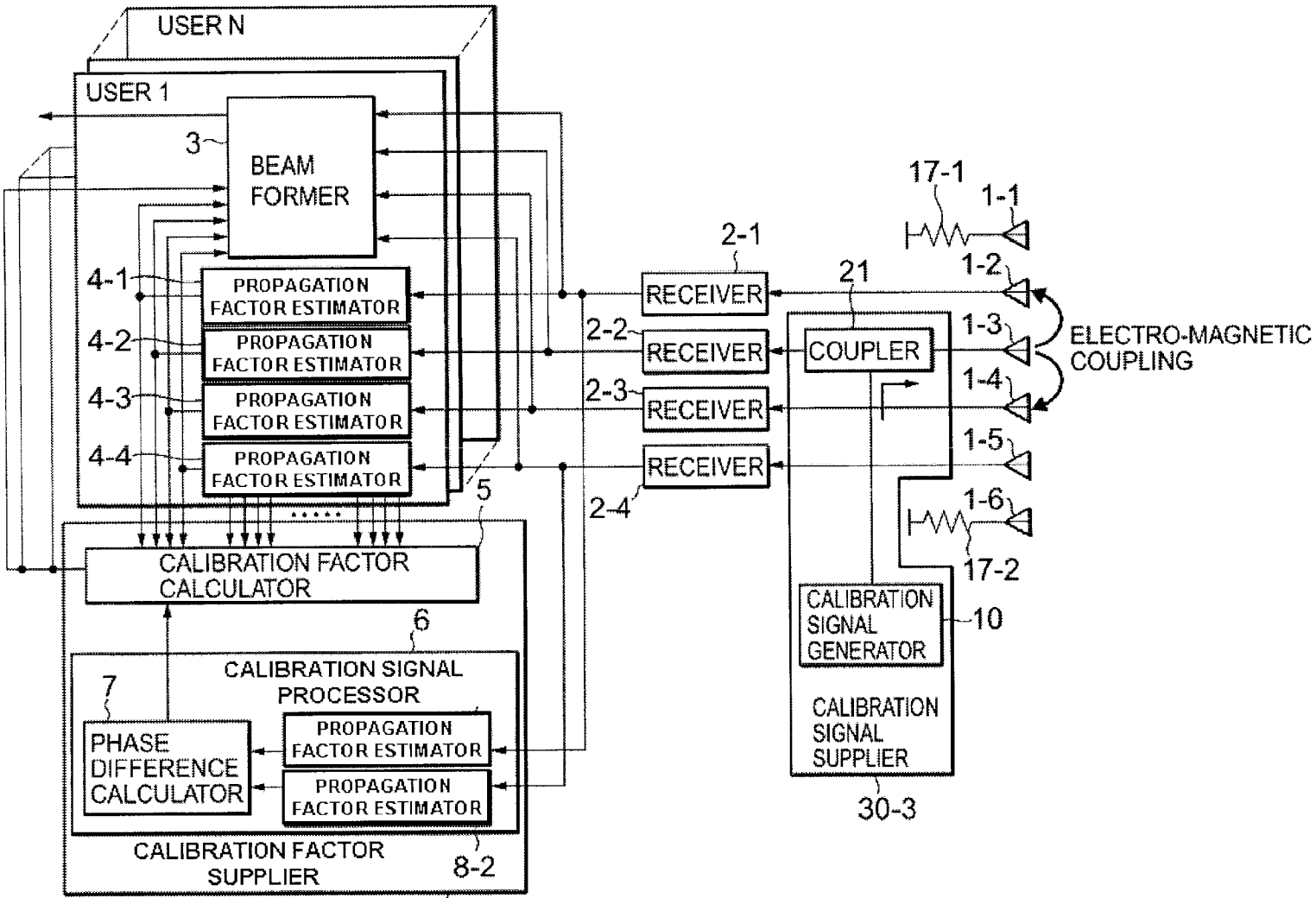
FIG. 3 is a block diagram for showing a configuration of an array antenna calibration apparatus according to a second embodiment of the present invention.

A configuration of the second embodiment of the present invention is shown in FIG. 3. In FIG. 3, the components having the same functions as those of the first embodiment are indicated by the same reference numerals and so their description is omitted. In this present embodiment, a calibration signal supplier 30-3 comprises the calibration signal generator 10 and a coupler which supplies a calibration signal to an arbitrary antenna element 1-3 of the antenna elements 1-2 through 1-4 connected with the receivers 2-1 through 2-4 respectively except both ends. The array antenna here is a typical linear array antenna, in which the antenna elements 1-1 and 1-6 disposed at the two ends are non-reflection terminators 17-1 and 17-2 respectively.

The calibration signal is transmitted by the arbitrary antenna element 1-3 of the antenna elements 1-2 through 1-4 connected with the receivers 2-1 through 2-4 respectively except both ends, to cause the antenna elements 1-2 and 1-4 respectively adjacent the antenna element 1-3 to measure electro-magnetically coupled calibration signals. Thus measured calibration signals can be used to perform calibration processing almost the same way as the first embodiment.

Third Embodiment

Figure 4:
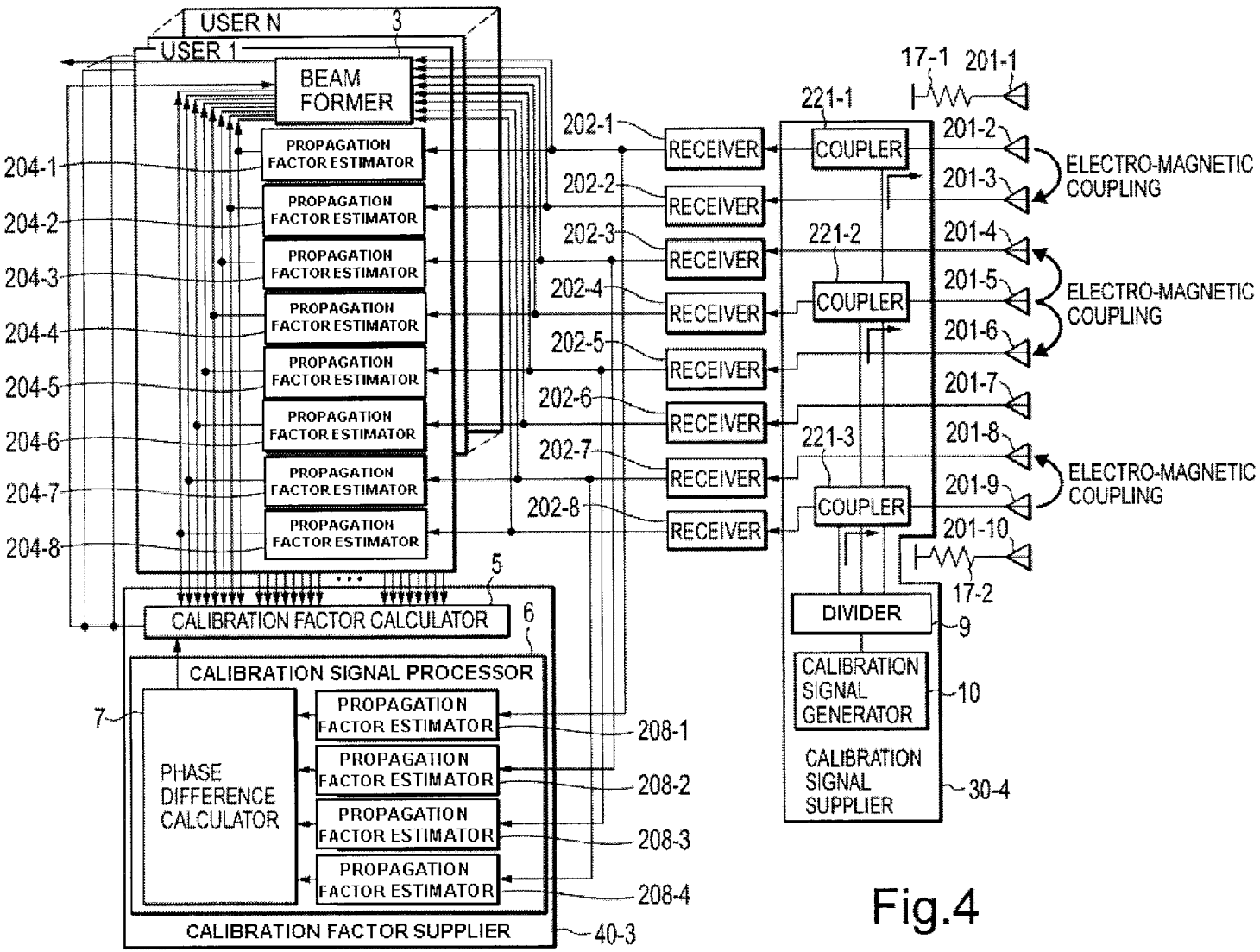
FIG. 4 is a block diagram for showing a configuration of an array antenna calibration apparatus according to a third embodiment of the present invention.
Figure 5:
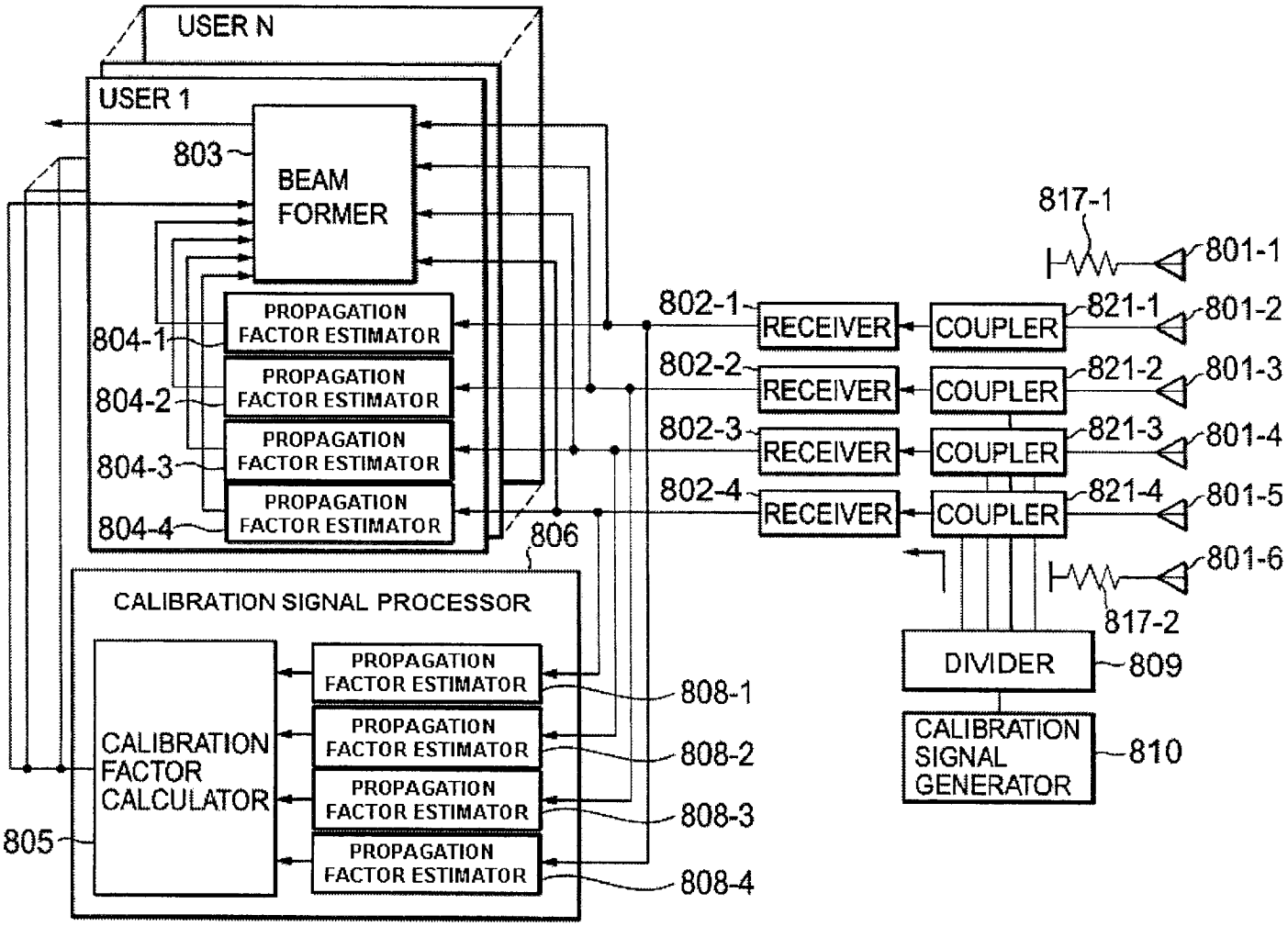
Fig.5 PRIOR ART
FIG. 5 is a block diagram for showing a configuration of an array antenna calibration apparatus according to a conventional example.
Figure 6:
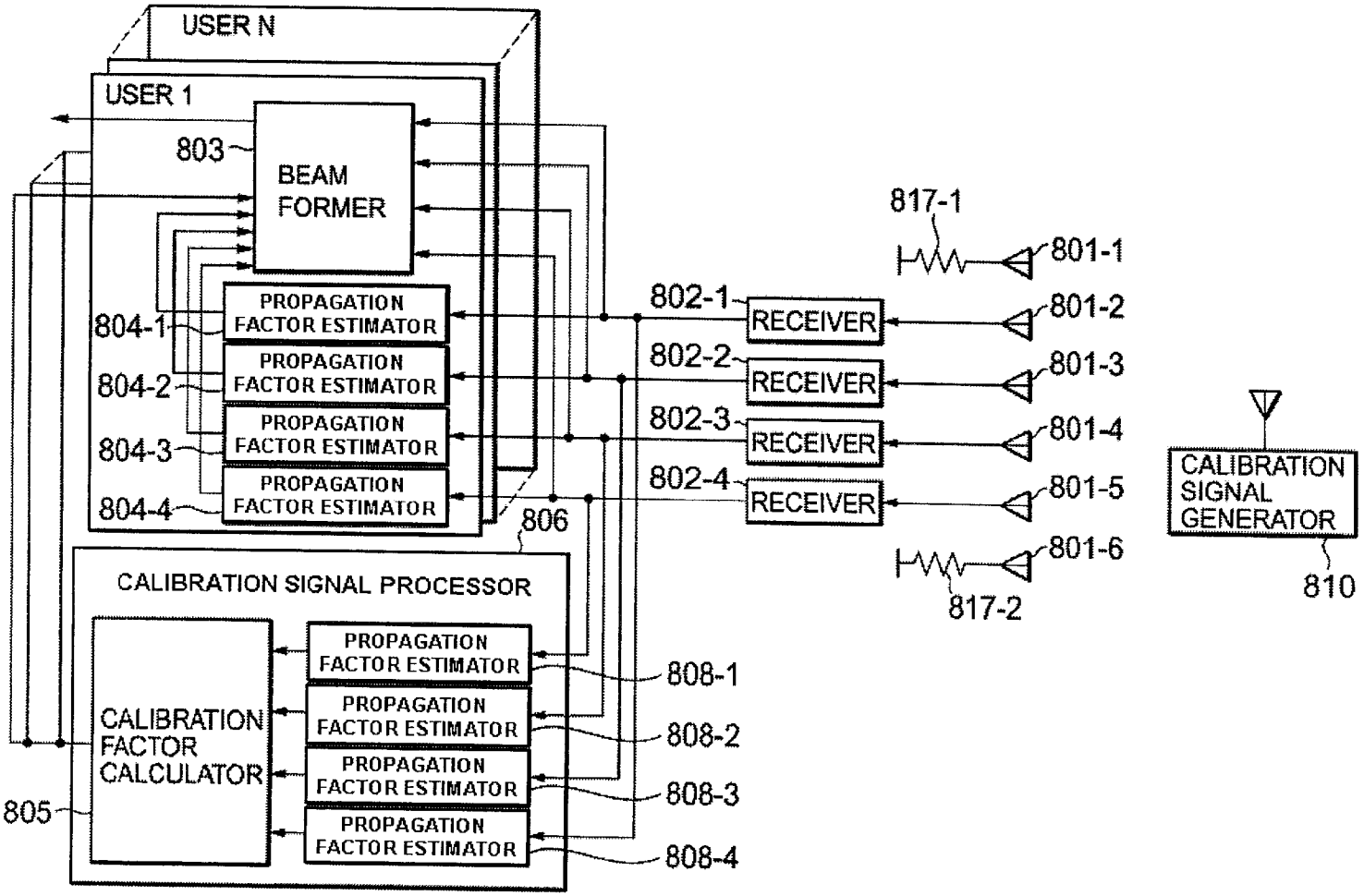
Fig.6 PRIOR ART
FIG. 6 is a block diagram for showing a configuration of an array antenna calibration apparatus according to another conventional example.

A configuration of the third embodiment of the present invention is shown in FIG. 4. In FIG. 4, the components having the same functions as those of the first embodiment are indicated by the same reference numerals and so their description is omitted. In the present embodiment, a calibration signal supplier 30-4 comprises the calibration signal generator 10, the divider 9, and a plurality of couplers 221-1 through 221-3 in such a configuration that the calibration signal is transmitted to an arbitrary number of antenna elements selected from antenna elements 201-2 through 201-9 connected to receivers 202-1 through 202-8 respectively.

As shown in FIG. 4, in the present embodiment, the same calibration signal is transmitted from an arbitrary number of the antenna elements selected from the antenna elements 201-1 through 201-9 connected to the receivers 202-1 through 202-8 respectively, so that the calibration signals detected by them can be used to perform calibration almost the same way as the first embodiment.

Furthermore, as shown in FIG. 4, in the present embodiment, it is also possible to transmit calibration signals from the antenna elements 201-2, 201-5, and 201-9, so that these calibration signals can be received by the adjacent antenna elements 201-3, 201-4, 201-6, and 201-8 to perform calibration. The phase difference calculator 7 of the calibration signal processor 6, however, uses as a phase difference a gradient which is given when the phases of the four propagation factors are approximated linearly. It is thus possible to mitigate the influence by the fluctuations in characteristics of the divider or the coupler on the calibration accuracy.

Fourth Embodiment

The present invention is applicable also to a base station of a TDMA or FDMA communication system. When it is applied to a TDMA communication system, the calibration signal is measured by allocating a time slot for the calibration signal or using an empty time slot to input the calibration signal therein. Furthermore, the propagation factors are estimated for a plurality of time slots and subjected to geometric averaging. Thus obtained phase difference and average propagation factor of the calibration signals are used to calculate a calibration factor. If it is applied to an FDMA communication system, on the other hand, the calibration signal is measured by allocating a frequency channel for the calibration signal or using an empty frequency channel to input the calibration signal therein. Furthermore, the propagation factors are estimated for a plurality of frequency channels and subjected to geometric averaging. Thus obtained phase difference and average propagation factor of the calibration signals are used to calculate a calibration factor.

As described above, the fluctuations in relative amplitude and relative phase of a path ranging from the incident surfaces of the antenna elements to the outputs of the receivers can be removed without providing an external calibration station, thus giving an effect of accurate beam forming.

What is claimed is:

1. A calibration apparatus used in an array antenna having a plurality of antenna elements, comprising:

a plurality of first antenna elements in said antenna elements for calibration;

a calibration signal supplier for supplying a calibration signal to a second antenna element near at least two said first antenna elements of said array antenna, or a coupler connected to said first antenna element;

a calibration factor supplier for obtaining a relative phase fluctuation and a relative amplitude fluctuation between said antenna elements of said array antenna based on the calibration signal received by said at least two first antenna elements and user signals received respectively by said antenna elements of said array antenna; and a beam former for calibrating said user signals received respectively by said antenna elements of said array antenna using said relative phase fluctuation and said relative amplitude fluctuation.

2. The calibration apparatus as claimed in claim 1, wherein said calibration factor supplier includes:

means for obtaining a propagation factor relating to said calibration signal for each of said first antenna elements based on said calibration signal received by each of said first antenna elements;

means for obtaining a first phase difference of said propagation factor relating to said calibration signal between said first antenna elements based on said propagation factor;

means for obtaining an average of said phase differences of said propagation factors relating to said calibration signals between said first antenna elements based on said phase differences of said propagation factors;

means for obtaining an average of the propagation factors relating to said user signals for each of said antenna elements of said array antenna based on said user signals;

means for obtaining a phase difference between said antenna elements caused by a difference in length of arrival paths based on said average of said phase differences and said average of said propagation factors;

means for obtaining a first time-average of the relative phase fluctuations of each of said antenna elements with respect to the one of said first antenna elements as a reference, based on said average of said propagation factors relating to said user signals for each of said antenna elements of said array antenna, said average of said propagation factors relating to said user signals for each of said first antenna elements, and said phase difference between said antenna elements caused by the difference in length of said arrival paths; and means for obtaining a second time-average of the relative phase fluctuations of said first antenna which are not used as a reference, based on the phase difference of said propagation factors relating to said calibration signal between said first antenna elements.

3. The calibration apparatus as claimed in claim 1, wherein said calibration factor supplier includes:

means for obtaining the propagation factor relating to said calibration signal for each of said first antenna elements based on said calibration signal received by each of said first antenna elements;

means for obtaining the phase difference of said propagation factor relating to said calibration signal between said first antenna elements based on said propagation factor relating to said calibration signal;

means for obtaining the average of said phase differences of said propagation factors relating to said calibration signals between said first antenna elements based on said phase differences of said propagation factors;

means for obtaining the average of said propagation factors relating to said user signals for each of said antenna elements of said array antenna;

means for obtaining the phase difference between said antenna elements caused by the difference in length of the arrival paths based on said average of said phase differences of said propagation factors and said average of said propagation factors; and means for obtaining a time-average of the relative amplitude fluctuations for each of said antenna elements of said array antenna with respect to one of said antenna elements of said array antenna based on said average of the propagation factors.

4. An array antenna calibrating method comprising the steps of:

supplying a calibration signal to a second antenna element near at least two said first antenna elements of said array antenna, or a coupler connected to said first antenna element;

obtaining a relative phase fluctuation and a relative amplitude fluctuation between said antenna elements of said array antenna based on the calibration signal received by said at least two first antenna elements and user signals received respectively by said antenna elements of said array antenna; and calibrating said user signals received respectively by said antenna elements of said array antenna using said relative phase fluctuation and said relative amplitude fluctuation.

5. The array calibration method of claim 4, wherein said step of obtaining a relative phase fluctuation includes:

a calibration signal propagation factor estimating step for obtaining a propagation factor relating to said calibration signal for each of said first antenna elements based on said calibration signal received by each of said first antenna elements;

a calibration signal phase difference calculating step for obtaining a first phase difference of said propagation factor relating to said calibration signal between said first antenna elements based on said propagation factor;

a phase difference geometric average calculating step for obtaining an average of said phase differences of said propagation factors relating to said calibration signals between said first antenna elements based on said phase differences of said propagation factors;

a user signal propagation factor estimating step for obtaining an average of the propagation factors relating to said user signals for each of said antenna elements of said array antenna based on said user signals;

an arrival path phase difference calculating step for obtaining a phase difference between said antenna elements caused by a difference in length of arrival paths based on said average of said phase differences and said average of said propagation factors;

a first relative phase fluctuation calculating step for obtaining a first time-average of the relative phase fluctuations of each of said antenna elements with respect to the one of said first antenna elements as a reference, based on said average of said propagation factors relating to said user signals for each of said antenna elements of said array antenna, said average of said propagation factors relating to said user signals for each of said first antenna elements, and said phase difference between said antenna elements caused by the difference in length of said arrival paths; and a second relative phase fluctuation calculating step for obtaining a second time-average of the relative phase fluctuations of said first antenna which are not used as a reference, based on the phase difference of said propagation factors relating to said calibration signal between said first antenna elements.

6. The array calibration method of claim 4, wherein said step of obtaining a relative amplitude fluctuation includes:

a calibration signal propagation factor estimating step for obtaining the propagation factor relating to said calibration signal for each of said first antenna elements based on said calibration signal received by each of said first antenna elements;

a calibration signal phase difference calculating step for obtaining the phase difference of said propagation factor relating to said calibration signal between said first antenna elements based on said propagation factor relating to said calibration signal;

a phase difference geometric average calculating step for obtaining the average of said phase differences of said propagation factors relating to said calibration signals between said first antenna elements based on said phase differences of said propagation factors;

a user signal propagation factor estimating step for obtaining the average of said propagation factors relating to said user signals for each of said antenna elements of said array antenna;

an arrival path phase difference calculating step for obtaining the phase difference between said antenna elements caused by the difference in length of the arrival paths based on said average of said phase differences of said propagation factors and said average of said propagation factors; and a relative amplitude fluctuation calculating step for obtaining a time-average of the relative amplitude fluctuations for each of said antenna elements of said array antenna with respect to one of said antenna elements of said array antenna based on said average of the propagation factors.

* * * * *